US010731342B2

(12) United States Patent
Nielsen

(10) Patent No.: US 10,731,342 B2
(45) Date of Patent: Aug. 4, 2020

(54) PANEL FOR A SUSPENDED CEILING OR THE LIKE AND METHOD OF MOUNTING A FABRIC ON A FRAME OF A SUSPENDED CEILING OR THE LIKE

(71) Applicant: KVADRAT SOFT CELLS A/S, Ebeltoft (DK)

(72) Inventor: Jesper Nielsen, Copenhagen (DK)

(73) Assignee: KVADRAT SOFT CELLS A/S, Ebeltoft (DK)

( * ) Notice: Subject to any disclaimer, the term of this patent is extended or adjusted under 35 U.S.C. 154(b) by 0 days.

(21) Appl. No.: 16/315,902

(22) PCT Filed: Jul. 8, 2016

(86) PCT No.: PCT/IB2016/054105

§ 371 (c)(1),
(2) Date: Jan. 7, 2019

(87) PCT Pub. No.: WO2018/007856

PCT Pub. Date: Jan. 11, 2018

(65) Prior Publication Data

US 2019/0249428 A1 Aug. 15, 2019

(51) Int. Cl.

| | |
|---|---|
| ***E04B 9/04*** | (2006.01) |
| ***E04B 9/30*** | (2006.01) |
| ***B44D 3/18*** | (2006.01) |

(52) U.S. Cl.

CPC ..... *E04B 9/303* (2013.01); *B44D 3/185* (2013.01); *E04B 9/04* (2013.01); *E04B 9/0428* (2013.01); *E04B 2009/0492* (2013.01)

(58) Field of Classification Search

CPC ..... E04B 2009/0492; E04B 9/0428; E04B 9/303; E04B 9/32; E04F 13/005; B44D 3/185

(Continued)

(56) References Cited

U.S. PATENT DOCUMENTS

2007/0157535 A1* 7/2007 Cousin ..... E04B 9/001 52/506.06
2011/0203210 A1* 8/2011 Cousin ..... E04B 9/0428 52/506.06
2019/0242123 A1* 8/2019 Kouijzer ..... F21V 7/05

FOREIGN PATENT DOCUMENTS

AT 10397 U2 2/2009
DE 3243525 A1 * 5/1984

(Continued)

OTHER PUBLICATIONS

European Patent Office, International Preliminary Report on Patentability in International Application No. PCT/IB2016/054105 (dated Jun. 4, 2018).

(Continued)

*Primary Examiner* — Robert Canfield
(74) *Attorney, Agent, or Firm* — Neal, Gerber & Eisenberg LLP; Thomas E. Williams; Daniel L. Organ

(57) ABSTRACT

The panel (1) includes a frame (4) with a fabric (5) stretchable over a lower side (6) thereof. An edge (8) of the fabric (5) is attached to a peripheral side (9) of the frame by means of a number of fastening brackets (11) distributed along the edge of the fabric. Firstly, each fastening bracket is attached to the peripheral side at a first lower position (15) in which the fabric is hanging loosely under the frame by hanging a hook-formed element (13) of the fastening brackets on a first lower protrusion (17) provided at the peripheral. Secondly, each fastening bracket is repositioned from said first lower position to a second upper position (16) in which the fabric is stretched over the lower side of the frame by hanging the hook-formed element of the fastening brackets on a second upper protrusion (18) provided at the peripheral side of the frame.

20 Claims, 12 Drawing Sheets

(58) Field of Classification Search
USPC ..... 52/222, 506.06, 511; 160/378
See application file for complete search history.

(56) References Cited

FOREIGN PATENT DOCUMENTS

| | | | | | |
|---|---|---|---|---|---|
| DE | 10253343 | A1 | | 5/2004 | |
| DE | 202014104186 | U1 | | 9/2015 | |
| EP | 0338925 | A1 | | 10/1989 | |
| EP | 0597094 | A1 | | 5/1994 | |
| EP | 1559846 | A1 | | 8/2005 | |
| EP | 2322734 | A2 | | 5/2011 | |
| FR | 3010424 | A1 | * | 3/2015 | ..... E04B 9/303 |
| JP | 2002124118 | A | * | 4/2002 | ..... E04B 9/303 |
| WO | WO 1989/10454 | A1 | | 11/1989 | |
| WO | WO 2018/007856 | A1 | | 1/2018 | |

OTHER PUBLICATIONS

European Patent Office, International Search Report in International Application No. PCT/IB2016/054105 (dated Dec. 16, 2016).
European Patent Office, Written Opinion of the International Search Authority in International Application No. PCT/IB2016/054105 (dated Dec. 16, 2016).

* cited by examiner

PANEL FOR A SUSPENDED CEILING OR THE LIKE AND METHOD OF MOUNTING A FABRIC ON A FRAME OF A SUSPENDED CEILING OR THE LIKE

The present invention relates to a panel for a suspended ceiling or the like, the panel having an upper side and a lower side and including an at least substantially rigid frame and a fabric adapted to be stretched over a lower side of the frame and forming the lower side of the panel, the frame having a lower peripheral edge over which the fabric may be stretched, and an edge of the fabric being adapted to be attached releasably to a peripheral side of the frame by means of a hook-formed element gripping over a protrusion provided at the peripheral side of the frame above the lower peripheral edge of the frame.

EP 1 559 846 A1 discloses a panel for a suspended ceiling or the like, comprising a frame defining an open region covered by fabric. The frame is at least along portions of its periphery provided with laterally displaceable attachment members accessible from outside the frame for attachment of the fabric to the frame, where a lateral displacement of said members away from the lower peripheral edge portion of the frame results in tensioning of the fabric across the open region of the frame. However, in order to conveniently access the laterally displaceable attachment members for attachment of the fabric, it is preferred to lower the panel in order to place it on a working table when mounting the fabric. It would be difficult to mount the fabric on a frame already mounted under a permanent ceiling in a building.

When mounting large panels for a suspended ceiling under a permanent ceiling in a building, it is customary to build panel bodies on site by means of panel body sections that are mounted under the permanent ceiling by means of wires. A large frame is arranged at the periphery of the panel body, and a fabric is stretched over a lower side of the frame. However, in order to mount the fabric in prior art panels, the entire panel composed by panel body sections and frame is lowered down on a working table by means of the wires. After mounting the fabric, the panel is hoisted up under the permanent ceiling again by means of the wires. The same procedure is followed in order to later exchange the fabric or perform repair of the panel.

EP 338 925 A1 discloses a false ceiling comprising a tensioned sheet secured along its edges to a support fixed to the ceiling or wall of a room of a building. The edges of the sheet are formed as a flexible element having a V-formed cross-section and being adapted to be pressed into and thereby inserted through a downward open groove in the support fixed to the ceiling or wall. When inserted, the flexible V-formed element expands inside a hollow of the support and grips over an edge of the downward open groove, thereby fixing the sheet to the support in a tensioned state. In order to hide the downward open groove, a finishing profile may be fitted by gluing or the like. However, it may be challenging to mount and tension the sheet appropriately without any resulting visible creases. Furthermore, either the support or the finishing profile will be visible after mounting the sheet.

DE 102 53 343 A1 discloses a stretched-foil wall or ceiling cover comprising a frame made up of profiles whose lower section is shaped so that its free edge forms an outer boundary of the visible foil area. The outer edge of the stretched-foil is provided with fixation means in the form of an anchor-formed collar gripping over a flange provided on an outer edge of the profiles of the frame. However, it may be challenging to mount and stretch the foil appropriately without any resulting visible creases.

EP 2 322 734 A2 discloses an arrangement of lighting panels positioned close to each other under a room ceiling. The lighting panels are connected with the room ceiling by means of retaining elements arranged between the panels. The retaining elements include a lowering unit at which the light elements are detachably fastened and by means of which the panels may be lowered. A foil is stretched over the lower side of the panels and may be tensioned by means of springs.

EP 0 597 094 A1 discloses a sheet setting-up device provided with a base portion having a hole for slidably receiving a bulged portion formed at an outermost edge portion of a sheet; a slit communicating with the hole and capable of receiving an edge portion of the sheet connectingly provided to the bulged portion; a hole capable of slidably receiving another bulged portion formed at an outermost edge portion of another sheet; and a slit communicating with the hole and capable of receiving an edge portion of another sheet connectingly provided to another bulged portion.

The object of the present invention is to provide a panel of the type mentioned by way of introduction, whereby the mounting and dismounting of large pieces of fabric on a frame already mounted under a permanent ceiling in a building is facilitated.

In view of this object, the edge of the fabric is adapted to be attached to the peripheral side of the frame by means of a number of fastening brackets distributed along the edge of the fabric, the fastening brackets are adapted to be selectively attached to the peripheral side of the frame, firstly at a first lower position in which the fabric is hanging loosely under the frame, and secondly at a second upper position in which the fabric is stretched over the lower side of the frame, and, in the first lower position of the fastening brackets, a hook-formed element of the fastening brackets grips over a first lower protrusion provided at the peripheral side of the frame and, in the second upper position of the fastening brackets, the hook-formed element of the fastening brackets grips over a second upper protrusion provided at the peripheral side of the frame.

In this way, the edge of the fabric may conveniently be attached by means of the fastening brackets around the entire frame, by hanging the fastening brackets in their first lower position in which the fabric is in a loose configuration. Subsequently, the fastening brackets may, one at a time, be repositioned from their first lower position to their second upper position, thereby stretching the fabric suitably. The positioning of the fastening brackets, carrying the fabric, in their first lower position and the subsequent repositioning of these to their second upper position on a frame already mounted under a permanent ceiling in a building may easily be done by hand or with a suitable tool.

In an embodiment, each fastening bracket has a first upper end at which the hook-formed element is arranged and a second lower end at which a support element is arranged, and the support element is adapted to abut the frame both in the first lower position of the fastening bracket and in the second upper position of the fastening bracket. Thereby, the fastening brackets may easily be attached securely to the frame both in their first lower position and in their second upper position.

In an embodiment, the support element is adapted to, in the first lower position of the fastening bracket, grip under an edge of the frame. Thereby, the fastening brackets may easily be attached even more securely to the frame in their first lower position. This may be advantageous, as substantially no stretching force from the fabric facilitates the attachment of the fastening brackets in their first lower position.

In an embodiment, the edge of the fabric is attached to each fastening bracket by means of at least one spring. Thereby, a suitable permanent stretching force may be applied to the fabric. Consequently, it may be ensured that the fabric is maintained suitably stretched.

In an embodiment, the edge of the fabric is attached to the first upper end of each fastening bracket by means of at least one spring. Thereby, a suitable permanent stretching force may be applied to the fabric. Furthermore, a more stable attachment of the fastening brackets to the frame may be achieved in the second upper position of the fastening brackets.

In an embodiment, the edge of the fabric is attached to the at least one spring by means of an elongated profile attached along the edge of the fabric. Thereby, the edge of the fabric may easily be attached to the fastening bracket by sliding the elongated profile in over the thickened area from an end of the edge of the fabric.

In an embodiment, the at least one spring is adapted to, in the first lower position of the fastening bracket, hold an edge of the elongated profile in a groove of the fastening bracket. Thereby, the fastening bracket and the elongated profile may be attached as a combined unit along the edge of the fabric, thereby facilitating the mounting of the fastening bracket on the frame in the first lower position.

In an embodiment, the fastening bracket is adapted to, at least in the first lower position of the fastening bracket, guide the at least one spring in a longitudinal direction of the fastening bracket, said longitudinal direction extending from the first upper end to the second lower end of the fastening bracket. Thereby, a more stable attachment of the fastening brackets to the frame may be achieved.

In an embodiment, the fastening bracket is adapted to, at least in the first lower position of the fastening bracket, take up the at least one spring between two side walls of the fastening bracket. Thereby, a more stable attachment of the fastening brackets to the frame may be achieved.

In a structurally particularly advantageous embodiment, the fastening bracket is formed from a plate material bent so that it forms a U-formed profile having a central wall and two side walls and extending in a longitudinal direction between a first upper end and a second lower end.

In an embodiment, the hook-formed element is formed as a flap bent around from an upper end of the central wall of the U-formed profile.

In an embodiment, a support element is formed as a flap bent around from a lower end of the central wall of the U-formed profile.

In a structurally particularly advantageous embodiment, a first end of a spring is attached to a pin extending between the two side walls of the U-formed profile at the first upper end of the U-formed profile, and a second end of the spring is attached to an edge of an elongated profile attached along the edge of the fabric.

In an embodiment, a groove is formed in a lower end of each of the two side walls of the U-formed profile at the second lower end of the U-formed profile, and the edge of the elongated profile fits into said grooves. Thereby, the at least one spring may hold the edge of the elongated profile in the groove of the fastening bracket, and the fastening bracket and the elongated profile may be attached as a combined unit along the edge of the fabric, thereby facilitating the mounting of the fastening bracket on the frame in the first lower position.

In an embodiment, the spring is adapted to hold the edge of the elongated profile in said grooves.

In an embodiment, the edge of the fabric is attached to the fastening bracket by means of an elongated profile gripping over a thickened area along the edge of the fabric. Thereby, the edge of the fabric may easily be attached to the fastening bracket by sliding the elongated profile in over the thickened area from an end of the edge of the fabric.

In a structurally particularly advantageous embodiment, the elongated profile has a tubular cross-section with a longitudinally extending slit through which the fabric extends.

In a structurally particularly advantageous embodiment, the thickened area along the edge of the fabric is formed by means of a hem with a string inside.

In an embodiment, the thickened area along the edge of the fabric is disrupted by means of mutually spaced indentations in the edge of the fabric. Thereby, some of the elongated profiles may be brought to slide in over the thickened area along the edges of the fabric through said indentations in the edge of the fabric. This may facilitate the mounting of the elongated profiles on the edges of the fabric, because sliding of the elongated profiles too long a distance along the edges of the fabric may be avoided.

In an embodiment, the thickened area along the edge of the fabric is disrupted by means of corner indentations in the edge of the fabric at corners of the fabric. Thereby, at least some of the elongated profiles may be brought to slide in over the thickened area along the edges of the fabric through said corner indentations. At the same time, the corner indentations may serve to avoid too much fabric at the corner which could otherwise lead to undesired folds or creases impairing the desired aesthetic look.

In a structurally particularly advantageous embodiment, the frame is composed by a number of elongated frame sections connected by means of corner sections.

In an embodiment, the edge of the fabric is adapted to be attached to the peripheral side of the frame by means of at least two fastening brackets distributed along each elongated frame section. Thereby, the mounting of the fabric on relatively large frames may be facilitated. As mentioned above, the fastening brackets may, one at a time, be repositioned from their first lower position to their second upper position, thereby stretching the fabric suitably. When more than one fastening bracket is employed along each elongated frame section, each fastening bracket may have to carry relatively less load and may therefore be easier to mount and to reposition from its first lower position to its second upper position.

In an embodiment, when the fastening bracket is in its first lower position, the edge of the fabric attached to the fastening bracket is positioned below the lower peripheral edge of the frame. Thereby, without demounting the fabric, access may be provided to the area above the fabric and inside the frame. This may be advantageous, for instance in the case that a light panel is provided inside the frame. In this case, the light panel may be serviced without demounting the fabric. Furthermore, dust on the upper side of the fabric may be particularly visible from below when light is on, and it may therefore be advantageous that easy access is provided to the inside of the panel so that dust may be removed without first demounting the fabric.

The present invention further relates to a method of mounting a fabric on an at least substantially rigid frame of a suspended ceiling or the like by stretching the fabric over a lower side of the frame, the fabric thereby forming a lower side of the panel, by stretching the fabric over a lower peripheral edge of the frame, and by attaching an edge of the fabric releasably to a peripheral side of the frame by means of a hook-formed element gripping over a protrusion provided at the peripheral side of the frame above the lower peripheral edge of the frame.

The method is characterised by attaching the edge of the fabric to the peripheral side of the frame by means of a number of fastening brackets distributed along the edge of the fabric, whereby, in a first step, each fastening bracket is attached to the peripheral side of the frame at a first lower position in which the fabric is hanging loosely under the frame by hanging a hook-formed element of the fastening brackets on a first lower protrusion provided at the peripheral side of the frame, and, in a second step, each fastening bracket is repositioned from said first lower position to a second upper position in which the fabric is stretched over the lower side of the frame by hanging the hook-formed element of the fastening brackets on a second upper protrusion provided at the peripheral side of the frame. Thereby, the above described features may be obtained.

In an embodiment, each fastening bracket has a first upper end at which the hook-formed element is arranged and a second lower end at which a support element is arranged, and the support element abuts the frame both in the first lower position of the fastening bracket and in the second upper position of the fastening bracket. Thereby, the above described features may be obtained.

In an embodiment, in the first step, when the fastening bracket is positioned in its first lower position, the support element is positioned to grip under an edge of the frame. Thereby, the above described features may be obtained.

In an embodiment, the edge of the fabric is attached to each fastening bracket by means of at least one spring. Thereby, the above described features may be obtained.

In an embodiment, the edge of the fabric is attached to the first upper end of each fastening bracket by means of at least one spring. Thereby, the above described features may be obtained.

In an embodiment, the edge of the fabric is attached to the at least one spring by attaching an elongated profile along the edge of the fabric. Thereby, the above described features may be obtained.

In an embodiment, the at least one spring, during the first step, in which the fastening bracket is arranged in its first lower position, holds an edge of the elongated profile in a groove of the fastening bracket. Thereby, the fastening bracket and the elongated profile may be attached as a combined unit along the edge of the fabric, thereby facilitating the mounting of the fastening bracket on the frame in the first lower position.

In an embodiment, the fastening bracket, at least during the first step in which the fastening bracket is arranged in its first lower position, guides the at least one spring in a longitudinal direction of the fastening bracket, said longitudinal direction extending from the first upper end to the second lower end of the fastening bracket. Thereby, the above described features may be obtained.

In an embodiment, the fastening bracket, at least during the first step in which the fastening bracket is arranged in its first lower position, takes up the at least one spring between two side walls of the fastening bracket. Thereby, the above described features may be obtained.

In an embodiment, the edge of the fabric is attached to the fastening bracket by sliding an elongated profile along the edge of the fabric so that the elongated profile is brought to grip over a thickened area along the edge of the fabric. Thereby, the above described features may be obtained.

In an embodiment, before attaching the fabric to the elongated profile, the at least one spring is brought to hold an edge of the elongated profile in a groove of the fastening bracket. Thereby, the fastening bracket and the elongated profile may be attached as a combined unit along the edge of the fabric, thereby facilitating the attachment of the fastening bracket to the fabric.

In a structurally particularly advantageous embodiment, the groove is formed in a second lower end of the fastening bracket.

In an embodiment, the elongated profile has a tubular cross-section with a longitudinally extending slit in which the fabric is inserted when sliding the elongated profile along the edge of the fabric. Thereby, the attachment of the elongated profile to the edge of the fabric is facilitated.

In an embodiment, the elongated profile is attached to the fastening bracket by means of at least one spring which is extended when the fastening bracket is repositioned from its first lower position to its second upper position. Thereby, a suitable permanent stretching force may be applied to the fabric. Consequently, it may be ensured that the fabric is maintained suitably stretched.

In an embodiment, the thickened area along the edge of the fabric is formed by means of a hem with a string inside. Thereby, the above described features may be obtained.

In an embodiment, the thickened area along the edge of the fabric is disrupted by means of mutually spaced indentations in the edge of the fabric, and at least one of the elongated profiles is brought to slide in over the thickened area along the edge of the fabric through one of said indentations in the edge of the fabric. This may facilitate the mounting of the elongated profiles on the edges of the fabric, because sliding of the elongated profiles too long a distance along the edges of the fabric may be avoided.

In an embodiment, the thickened area along the edge of the fabric is disrupted by means of corner indentations in the edge of the fabric at corners of the fabric, and at least one of the elongated profiles is brought to slide in over the thickened area along the edge of the fabric through one of said corner indentations in the edge of the fabric at corners of the fabric. Thereby, the above described features may be obtained.

In an embodiment, the frame is composed by a number of elongated frame sections connected by means of corner sections. In a structurally particularly advantageous embodiment, In an embodiment, the fabric is mounted on the at least substantially rigid frame after the frame has been arranged in its mounted position at a ceiling. This may be advantageous, for instance in the case of large panels built on site by means of several panel sections. Thereby, the panel sections may be directly mounted on the permanent ceiling without subsequently having to handle the resulting large panel.

In an embodiment, the fabric is mounted on the at least substantially rigid frame by rolling out a roll of fabric having preformed thickened areas along the edges of the fabric. Thereby, the thickened areas along the edges of the fabric may be preformed at a factory and therefore the mounting procedure on site may be facilitated.

In an embodiment, the fabric is mounted on the at least substantially rigid frame by placing a roll of fabric on a trolley and wheeling the trolley along the at least substantially rigid frame as the fabric is gradually rolled out from the roll of fabric. This may facilitate the handling of the fabric, because the fabric may be mounted on the at least substantially rigid frame gradually without having to support large free-hanging parts of the fabric.

In an embodiment, the fabric is mounted on the at least substantially rigid frame by firstly attaching a first end of the fabric to a number of fastening brackets and bringing said fastening brackets to releasably engage the peripheral side of the frame, secondly attaching an intermediate part of the fabric to a number of fastening brackets and bringing said fastening brackets to releasably engage the peripheral side of the frame, and thirdly attaching a second end of the fabric to a number of fastening brackets and bringing said fastening brackets to releasably engage the peripheral side of the frame. This may further facilitate the handling of the fabric, because the fabric may be mounted on the at least substantially rigid frame gradually without having to support large free-hanging parts of the fabric.

In an embodiment, all the fastening brackets necessary for mounting the fabric are brought to releasably engage the peripheral side of the frame in their first lower position before any of the fastening brackets is repositioned from its first lower position to its second upper position. Thereby, it may be ensured that the entire fabric is correctly placed and free for dust, before the fabric is finally tensioned and stretched over the frame. Thereby, repetitive correctional procedures may be avoided and time may be saved during mounting of the fabric.

In an embodiment, the intermediate part of the fabric is attached to at least some fastening brackets by sliding the elongated profiles in over the thickened area along the edge of the fabric through an indentation in the edge of the fabric. Thereby, sliding of the elongated profiles too long a distance along the edges of the fabric may be avoided.

In an embodiment, the first end of the fabric is the free end of fabric of a partly unrolled roll of fabric. This may facilitate handling of prefabricated rolled-up fabric.

The invention will now be explained in more detail below by means of examples of embodiments with reference to the very schematic drawing, in which FIG. 1 is a perspective view of a prior art setup for mounting a fabric on a frame of a panel suspended under a permanent ceiling;

Figure 1:
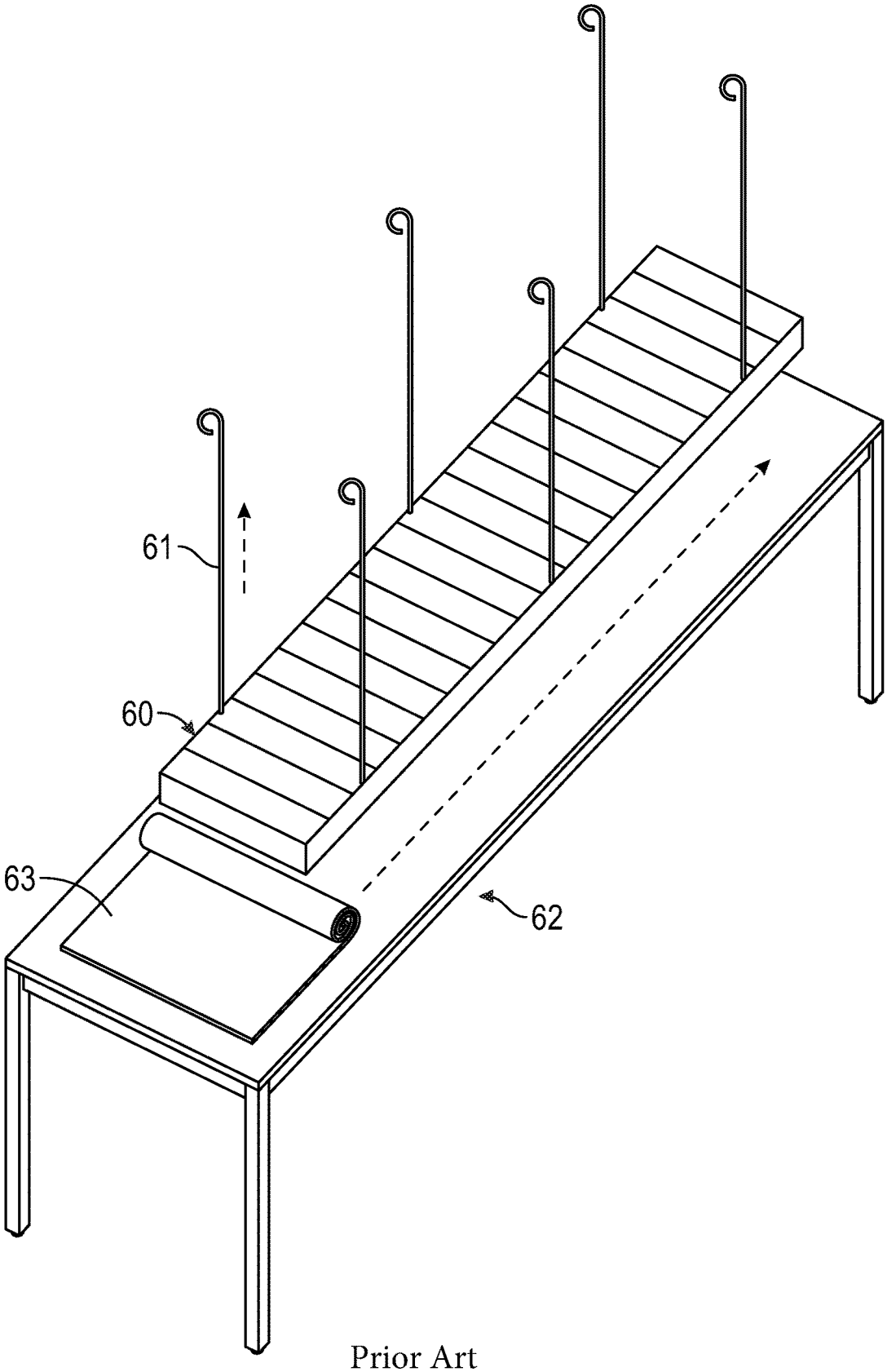
Prior Art FIG. 1

FIG. 1 illustrates a prior art method for mounting a fabric 63 on a frame of a panel 60 suspended under a not shown permanent ceiling by means of wires 61. The panel 60 is a relatively large, elongated panel which has been assembled on site by means of a number of panel body sections as indicated. According to customary practice, a large frame is arranged at the periphery of the panel body, and a fabric is stretched over a lower side of the frame. However, in order to mount the fabric in such prior art panels 60, the entire panel composed by panel body sections and frame is lowered down on a working table 62 by means of the wires 61. After mounting the fabric on the frame, the panel 60 is hoisted up under the permanent ceiling again by means of the wires 61. The same procedure is followed in order to later exchange the fabric or perform repair of the panel 60.

Figure 2:
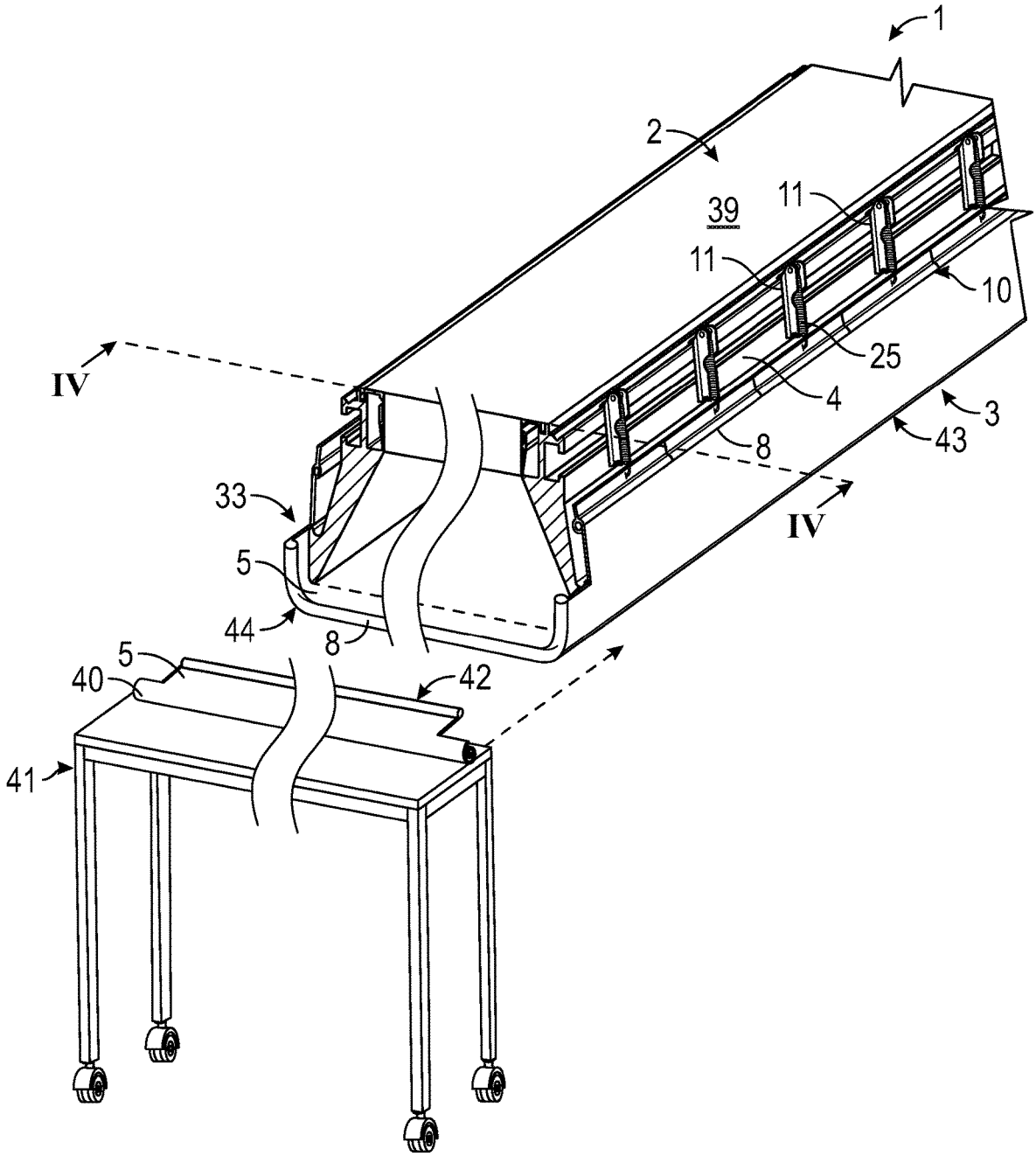
FIG. 2 is a perspective and partly cross-sectional view of a setup according to the present invention for mounting a fabric on frame of a panel suspended under a permanent ceiling.
Figure 3:
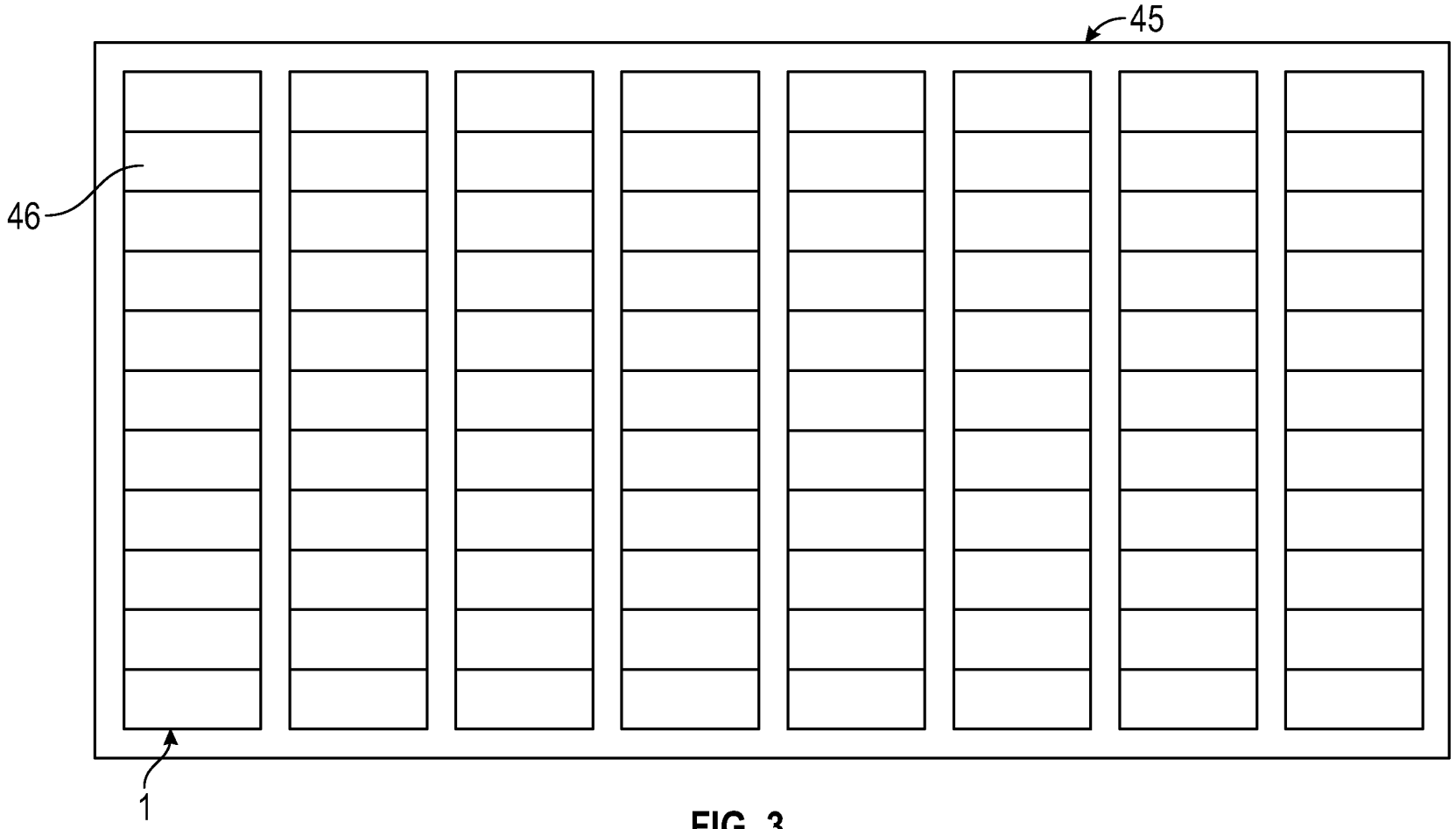
FIG. 3 is a top view of an arrangement of panels suspended under a permanent ceiling.

FIG. 2 illustrates the method according to the present invention for mounting a fabric 5 on a frame 4 of a panel 1 suspended under a not shown permanent ceiling. The panel 1 is illustrated in its mounted position under the permanent ceiling; however, the fittings or elements used for mounting are not illustrated, and furthermore, for illustrative purposes, the permanent ceiling is also not illustrated. The panel may be suspended under the permanent ceiling in any suitable way, such as by wires, brackets or the like. It is noted that FIG. 2 illustrates only part of the panel 1. Part of the panel 1 has been cut away along the line IV-IV. Furthermore, the opposite end of the panel 1 to the right in the figure has been cut away. In FIG. 3, it is illustrated, seen from above, how a number of elongated panels 1 composed by panel body sections 46 and not illustrated surrounding frames may be arranged under a permanent ceiling 45 of a room. For illustrative purposes, the permanent ceiling 45 is illustrated as transparent. In the following, the panel 1 will be described in detail, and subsequently, the method of mounting the fabric 5 on the frame 4 of the panel 1 will be described.

Figure 4:
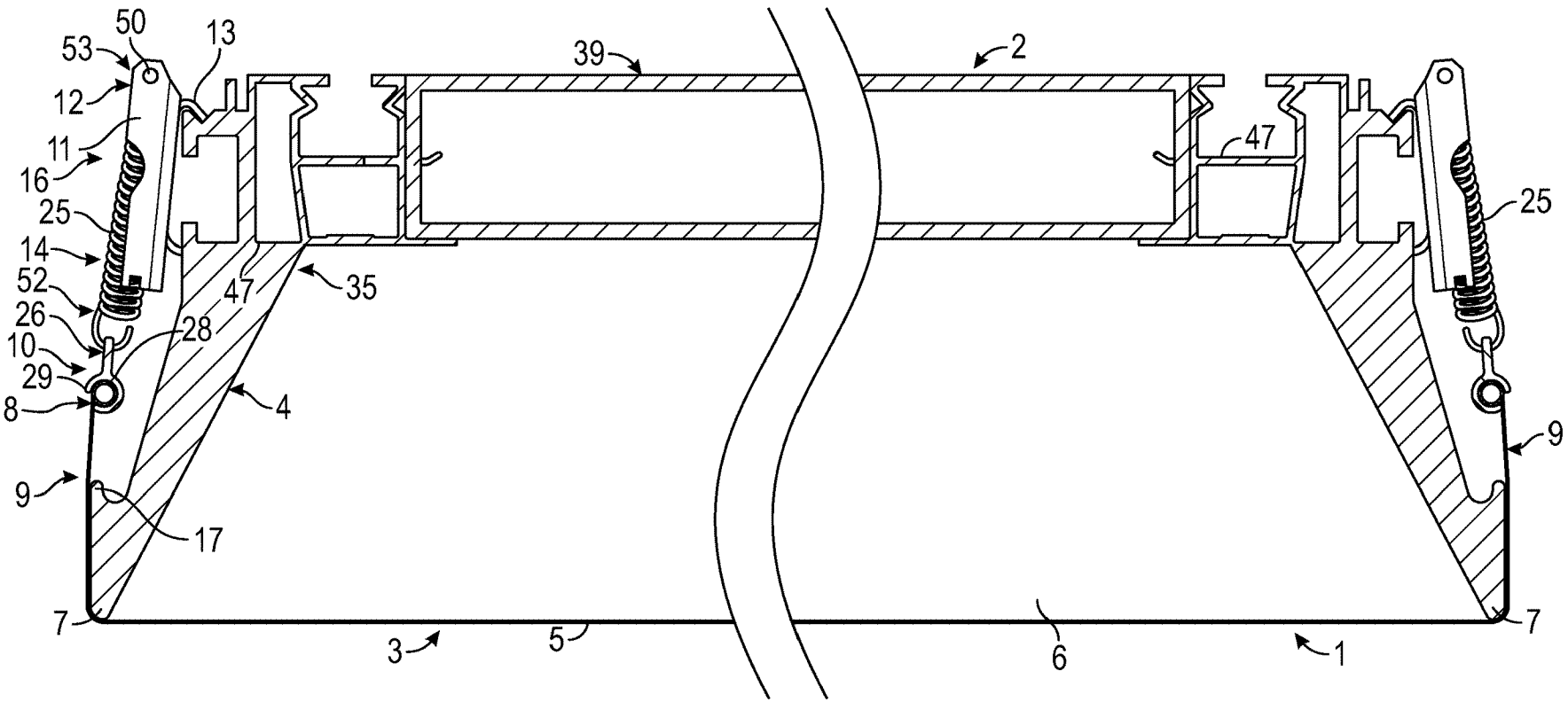
FIG. 4 is a cross-sectional view through the panel in FIG. 2 along the line IV-IV, illustrating a situation after the fabric has been stretched.
Figure 5:
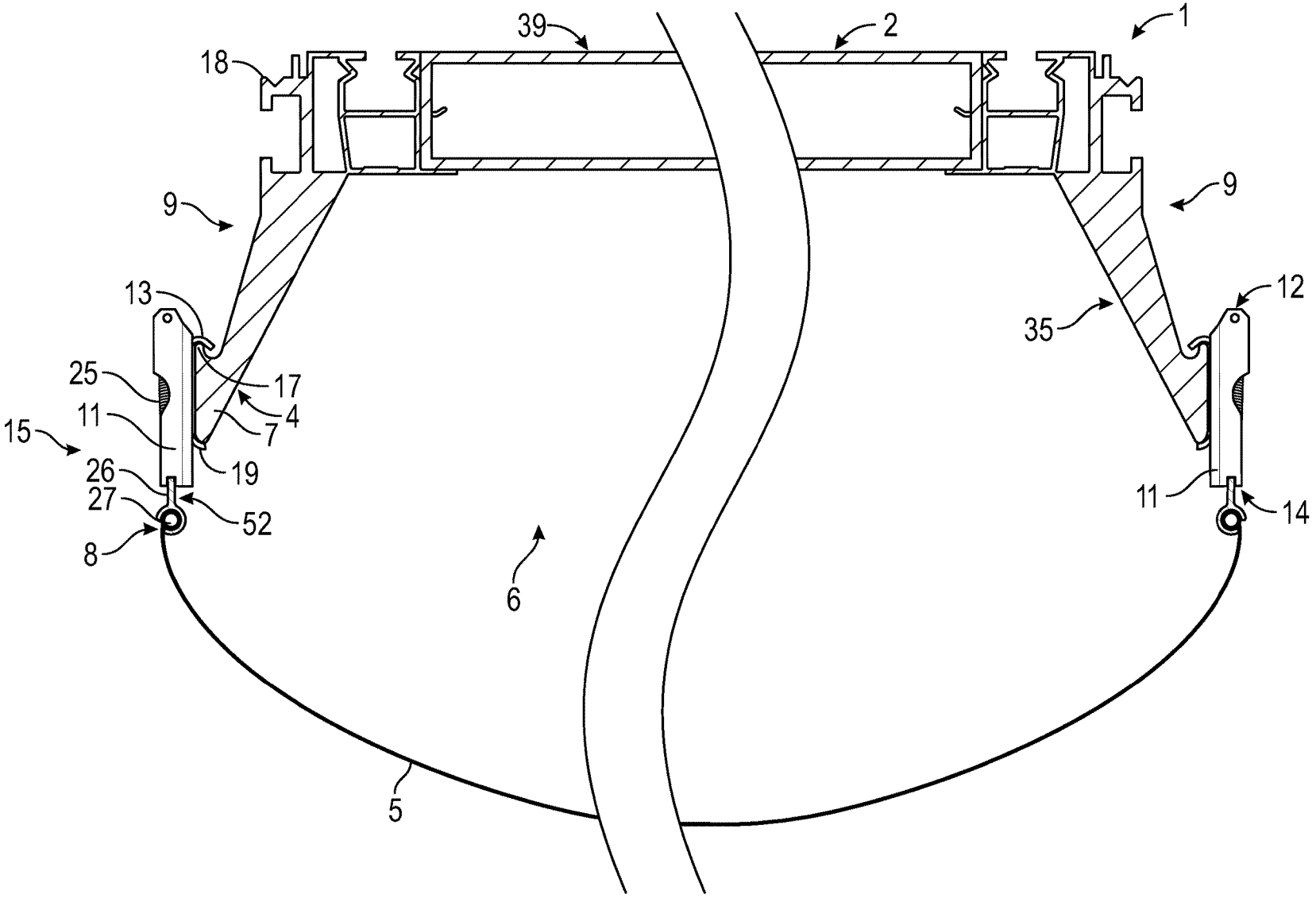
FIG. 5 is a cross-sectional view of the panel in FIG. 4, illustrating the situation before the fabric has been stretched.
Figure 12:
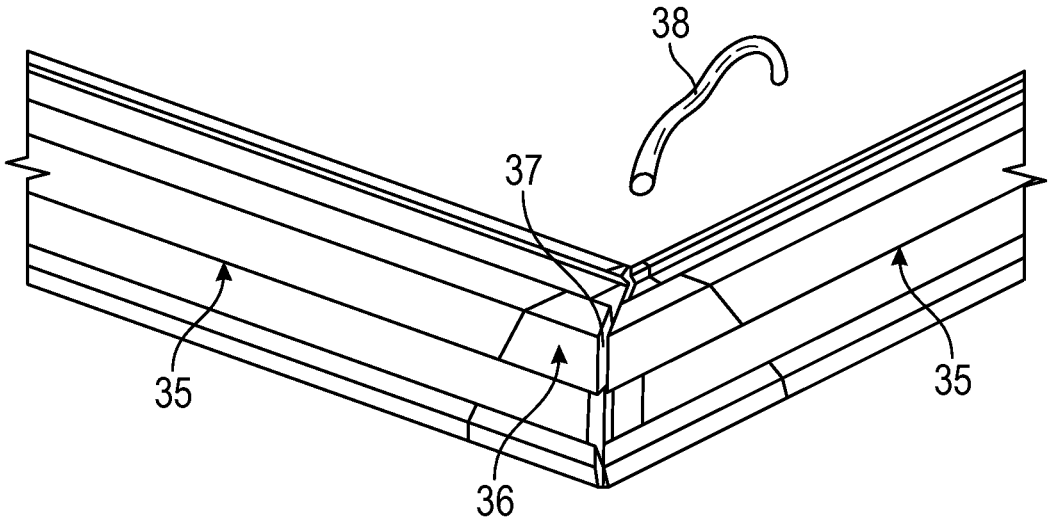
FIGS. 12 and 13 are perspective views illustrating an embodiment of a corner section connecting elongated frame sections of a frame of a panel.
Figure 13:
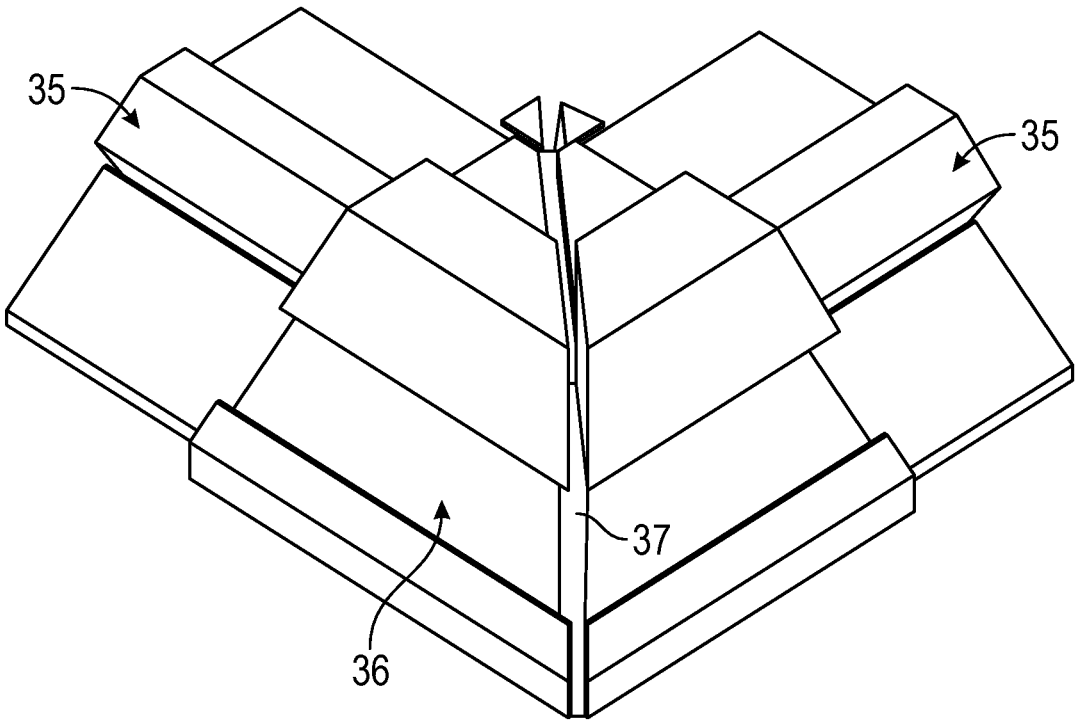

Referring to FIGS. 4 and 5, it is seen that the panel 1 according to the present invention has an upper side 2 and a lower side 3 and includes an at least substantially rigid frame 4. In the illustrated embodiment, the frame 4 is mounted on and surrounds a panel body 39. The frame 4 is composed by four elongated frame sections 35 connected by means of corner sections 36 as illustrated in FIGS. 12 and 13. The elongated frame sections 35 are mounted on the panel body 39 by means of connection parts 48 of the respective elongated frame sections 35. The panel body 39 may for instance be a sound insulating panel, a light panel, a thermal panel or it may be left out in case the panel 1 is purely intended to bring about an aesthetic look. In the latter case, the frame 4 may be self-supporting and may be provided with mounting means for mounting the panel on a permanent ceiling. Although the frame 4 is illustrated as being rectangular, it is evident to the skilled person that the frame 4 may alternatively have other forms, including square, circular, oval, etc.

The elongated frame sections 35 of the frame 4 are preferably produced from extruded aluminium profiles; however, any suitable material could be used. The a fastening bracket 11 is preferably produced from bent steel; however, any suitable material could be used.

A variety of different fabrics or cloth can be used for the fabric 5 according to the specific application and pertinent characteristics of the fabric are for instance its transparency to light and/or sound and its fire-retarding ability. The fabric 5 could be any kind of suitable woven material or foil such as textile or for instance fibreglass.

Referring to FIGS. 12 and 13, there is illustrated an embodiment of the corner sections 36 of the frame 4 of the panels 1 according to the invention. The corner section 36 according to this embodiment is provided with extensions for insertion into the corresponding profiles of the elongated frame sections 35 of the frame 4. In order to facilitate attachment of the fabric 5 to the corner section 36, the corner section can be provided with a groove 37 for insertion of the corner portion of the fabric 5, and this portion of the fabric can furthermore be retained in the groove 37 by means of a resilient member 38, for instance a piece of flexible cord of a suitable diameter. Other retaining means can of course also be envisaged. The corner sections 36 make it possible to assemble or disassemble the frame on site, which facilitates transport of the frame 4.

Referring again to FIGS. 4 and 5, it is seen that the fabric 5 is adapted to be stretched over a lower side 6 of the frame 4, whereby the fabric 5 forms the lower side 3 of the panel 1. The frame 4 has a lower peripheral edge 7 over which the fabric 5 is stretched, and an edge 8 of the fabric 5 is attached releasably to a peripheral side 9 of the frame 4 by means of a hook-formed element 13 gripping over a protrusion provided at the peripheral side 9 of the frame 4 above the lower peripheral edge 7 of the frame. It is noted that in the stretched state of the fabric 5 illustrated in FIG. 4, the edge 8 of the fabric 5 is positioned at an attachment position 10 located above the lower peripheral edge 7 of the frame. Thereby, the entire frame 4 may be concealed at least substantially in relation to a person standing on the floor of the room in which the frame is arranged. The edge 8 of the fabric is attached to the peripheral side 9 of the frame 4 by means of a number of fastening brackets 11 distributed along the edge 8 of the fabric 5, and the fastening brackets 11 are adapted to be attached, in a first step, to the peripheral side 9 of the frame 4 at a first lower position 15 in which the fabric 5 is hanging loosely under the frame 4, as illustrated in FIG. 5, and, in a second step, at a second upper position 16 in which the fabric 5 is stretched over the lower side 6 of the frame 4, as illustrated in FIG. 4. As seen, in the first lower position 15 of the fastening brackets 11, a hook-formed element 13 of the fastening brackets 11 grips over a first lower protrusion 17 provided on the peripheral side 9 of the frame 4 and, in the second upper position 16 of the fastening brackets 11, the hook-formed element 13 of the fastening brackets 11 grips over a second upper protrusion 18 provided on the peripheral side 9 of the frame 4. It is seen that in the illustrated embodiment, the first lower protrusion 17 and the second upper protrusion 18 are formed as integral parts of an extruded profile forming the elongated frame sections 35. However, the first lower protrusion 17 and the second upper protrusion 18 may have any suitable form in order for the hook-formed element 13 of the fastening brackets 11 to grip suitably over these.

Furthermore, although in the illustrated embodiment, the first lower protrusion 17 and the second upper protrusion 18 are formed as continuous protrusions, these may just as well be formed as a number of separate elements distributed along the elongated frame sections 35.

As seen in FIGS. 4 and 5, each fastening bracket 11 has a first upper end 12 at which the hook-formed element 13 is arranged and a second lower end 14 at which a support element 19 is arranged, and the support element 19 is adapted to abut the frame 4 both in the first lower position 15 of the fastening bracket 11 illustrated in FIG. 5 and in the second upper position 16 of the fastening bracket 11 illustrated in FIG. 4. It is noted that the definition of the first upper end 12 and the second lower end 14 of the fastening bracket 11 is related to the position and orientation of the fastening bracket 11 when it is in its second upper position or in its first lower position 16 as illustrated in FIGS. 4 and 5, respectively. Furthermore, it is seen that the support element 19 is adapted to, in the first lower position of the fastening bracket 11, grip under an edge of the frame 4. In the illustrated embodiment, said edge is also the lower peripheral edge 7 of the frame 4. However, said edge may in other embodiments be a separate edge arranged above the lower peripheral edge 7 of the frame.

In the illustrated embodiment, the edge 8 of the fabric 5 is attached to the first upper end 12 of each fastening bracket 11 by means of at least one spring 25. The spring 25 may be attached to the fastening bracket 11 at other positions, but attaching the spring 25 to the first upper end 12 of the fastening bracket 11 may allow the fastening bracket 11 a more stable grip when it hangs on the second upper protrusion 18 of the frame 4 as illustrated in FIG. 4.

Furthermore, the edge 8 of the fabric 5 is attached to the at least one spring 25 by means of an elongated profile 26 attached along the edge 8 of the fabric 5. The at least one spring 25 is adapted to, in the first lower position 15 of the fastening bracket 11, hold an edge 20 of the elongated profile 26 in a groove 21 of the fastening bracket 11.

Figure 6:
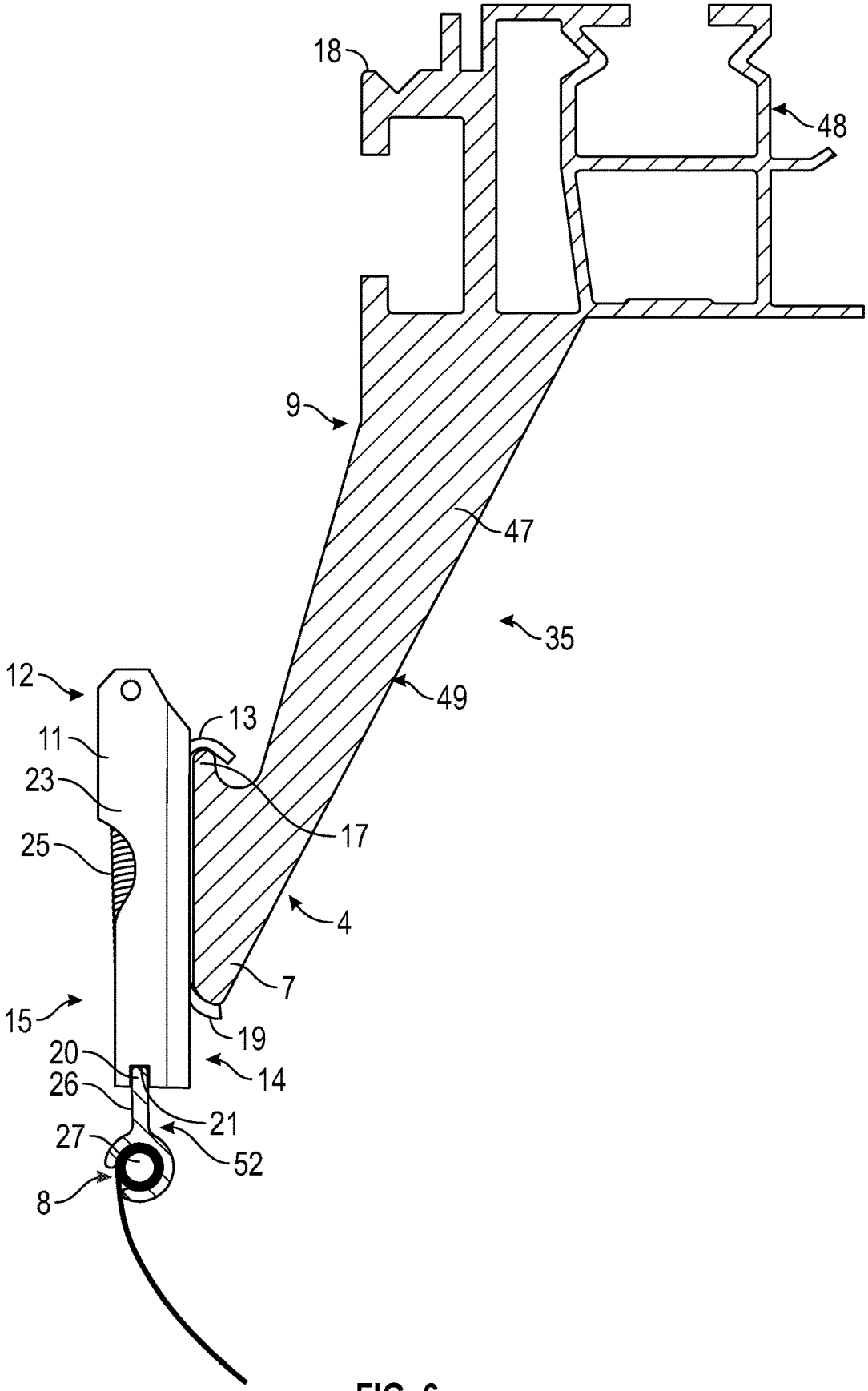
FIG. 6 is a cross-sectional view of part of the frame of the panel illustrated in FIG. 5.
Figure 8:
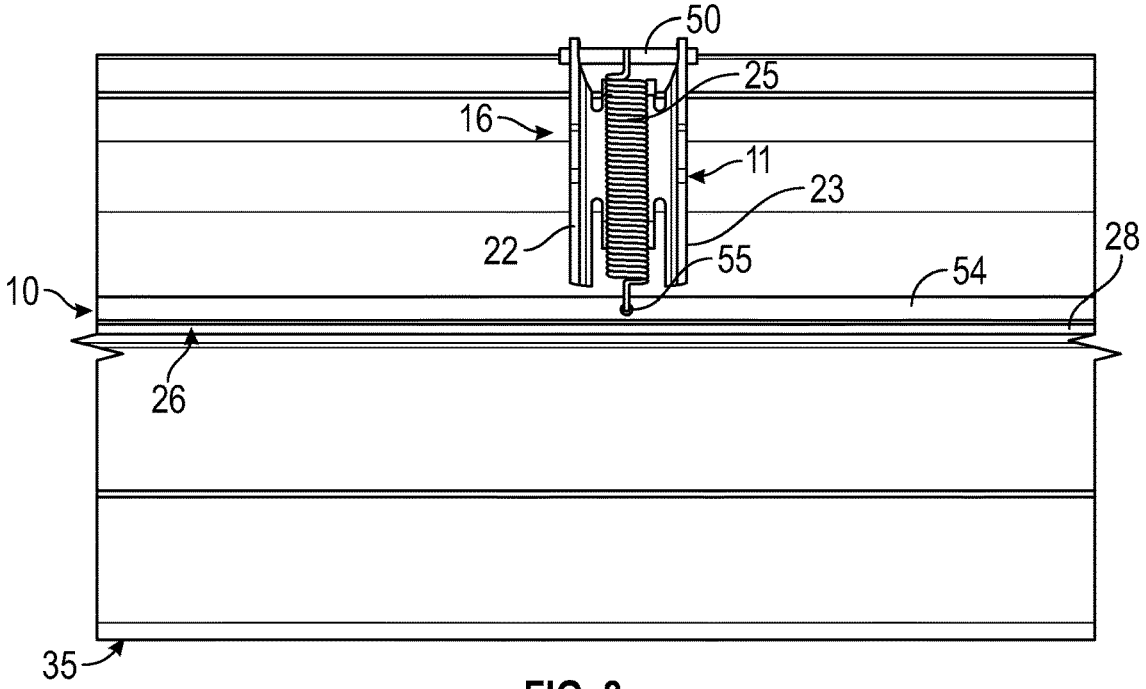
FIG. 8 is a side view of the part of the frame of the panel illustrated in FIG. 7.
Figure 9:
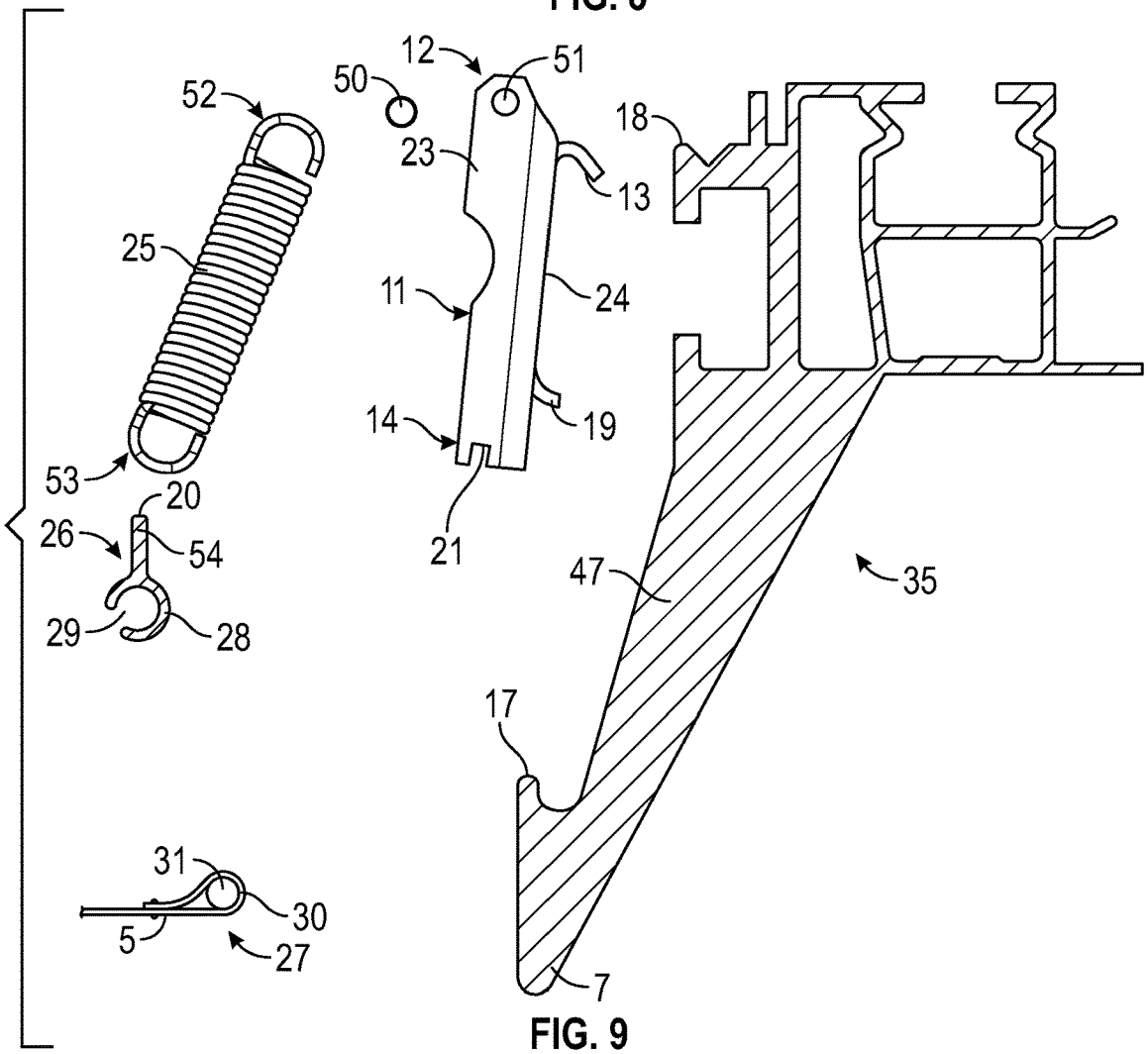
FIG. 9 is a cross-sectional exploded view of part of the frame of the panel illustrated in FIG. 4.
Figure 10:
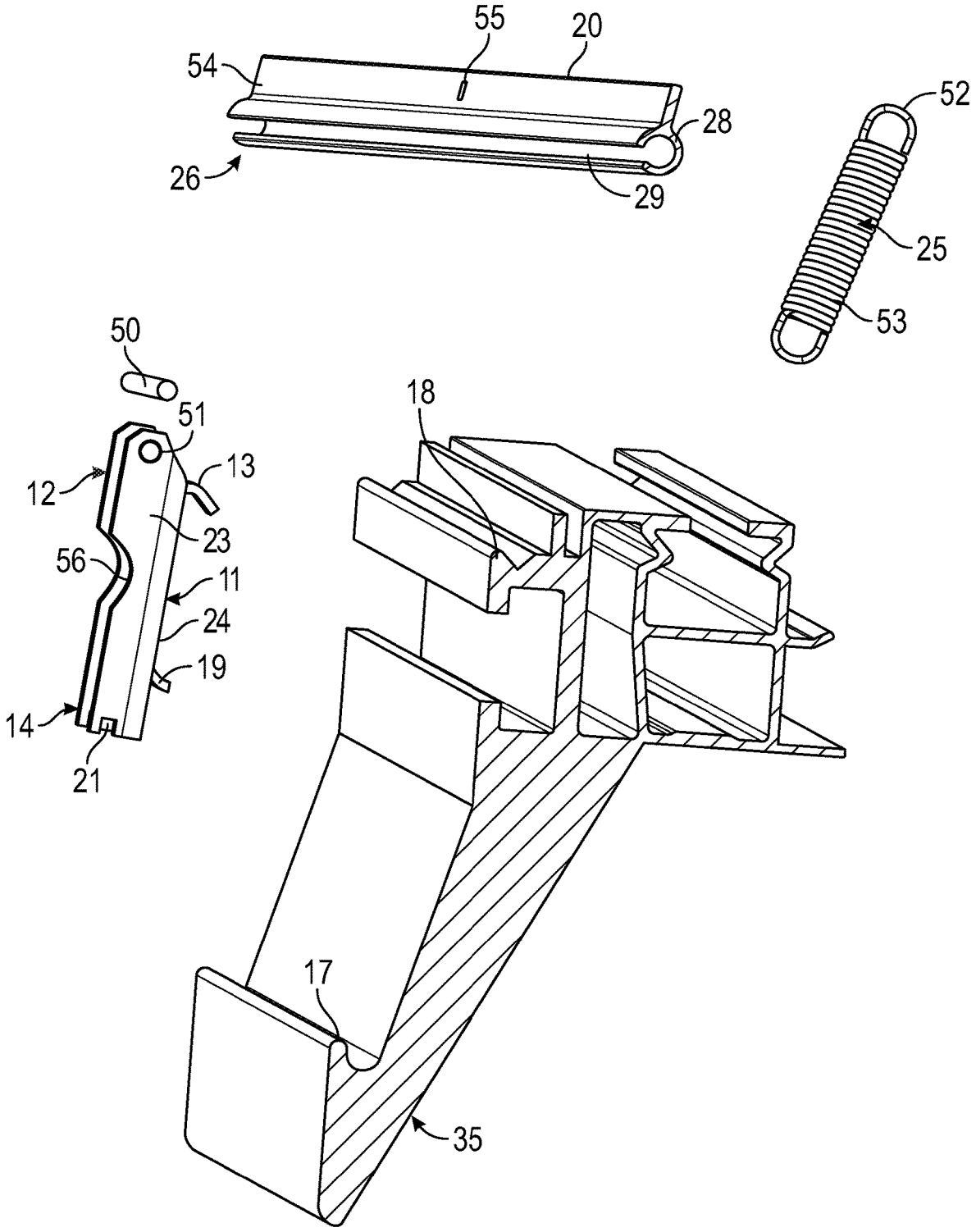
FIG. 10 is a perspective and cross-sectional exploded view corresponding to the view of FIG. 9.

Referring to FIG. 6, it is seen that the fastening bracket 11 is adapted to, at least in the first lower position 15 of the fastening bracket 11, guide the at least one spring 25 in a longitudinal direction of the fastening bracket 11, said longitudinal direction extending from the first upper end 12 to the second lower end 14 of the fastening bracket 11. In the illustrated embodiment, said guidance of the at least one spring 25 is achieved in that the fastening bracket 11 is adapted to take up the at least one spring 25 between two side walls 22, 23 of the fastening bracket 11. In FIG. 8 it is seen that, in the illustrated embodiment, the at least one spring 25 is also guided between the two side walls 22, 23 in the second upper position 16 of the fastening bracket 11.

Figure 7:
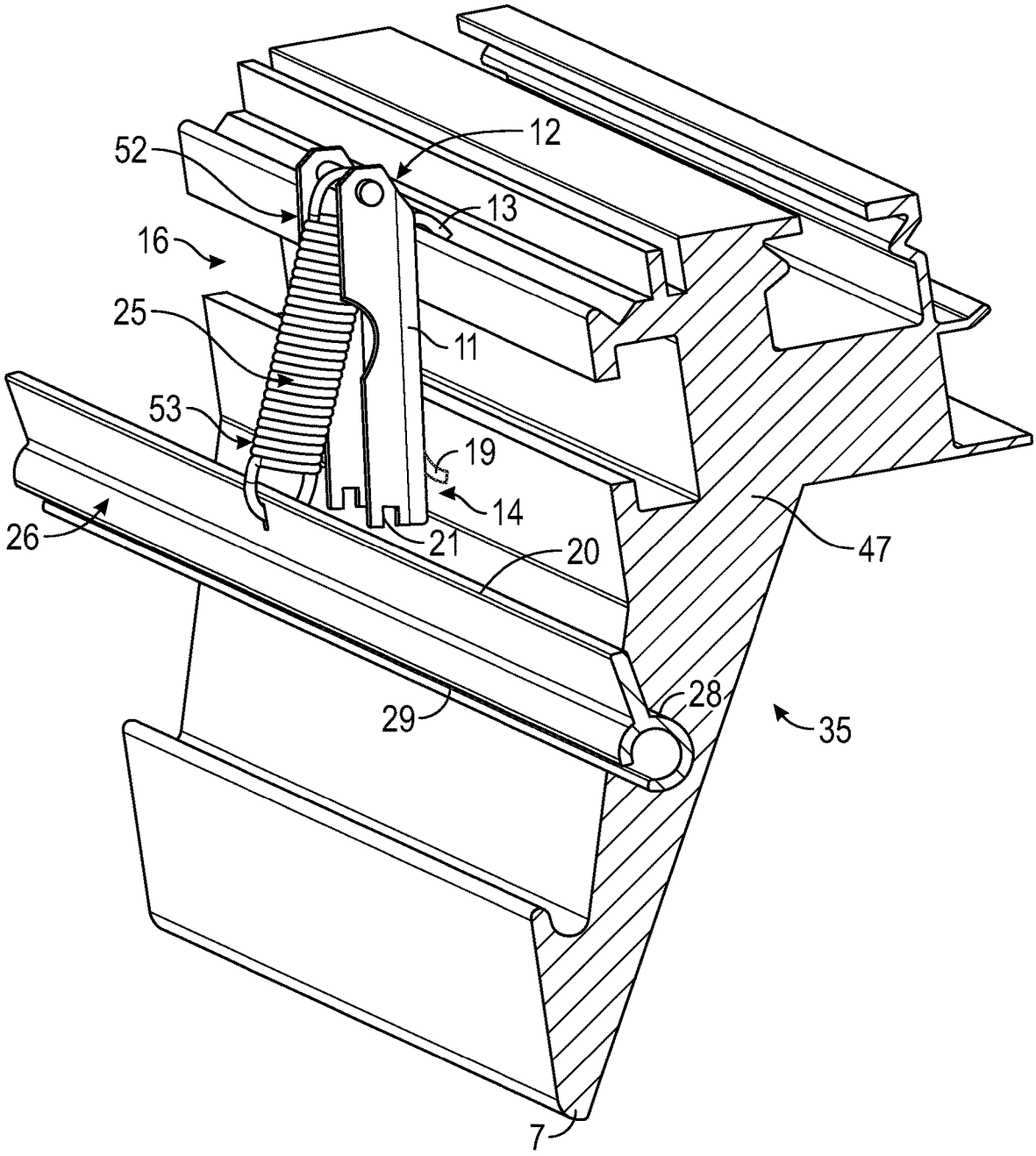
FIG. 7 is a perspective and cross-sectional view of the frame of the panel illustrated in FIG. 4, but without the fabric mounted.
Figure 11A:
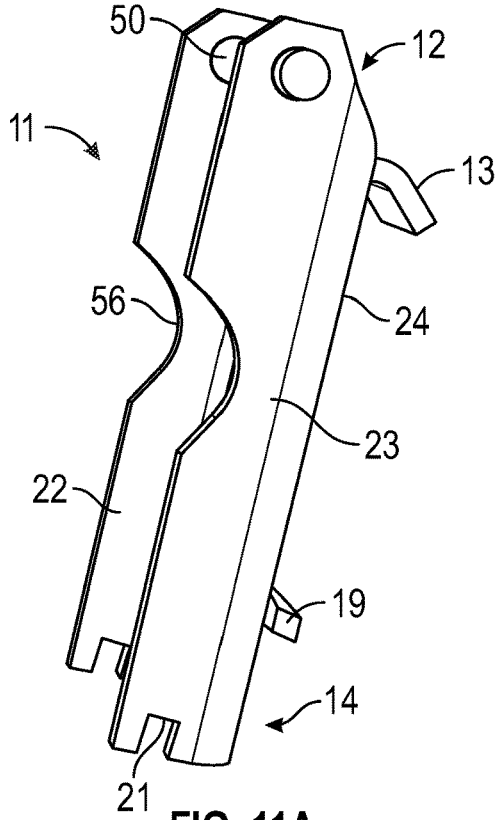
FIGS. 11A and 11B are perspective views of a fastening bracket of the panel illustrated in FIG. 4.
Figure 11B:
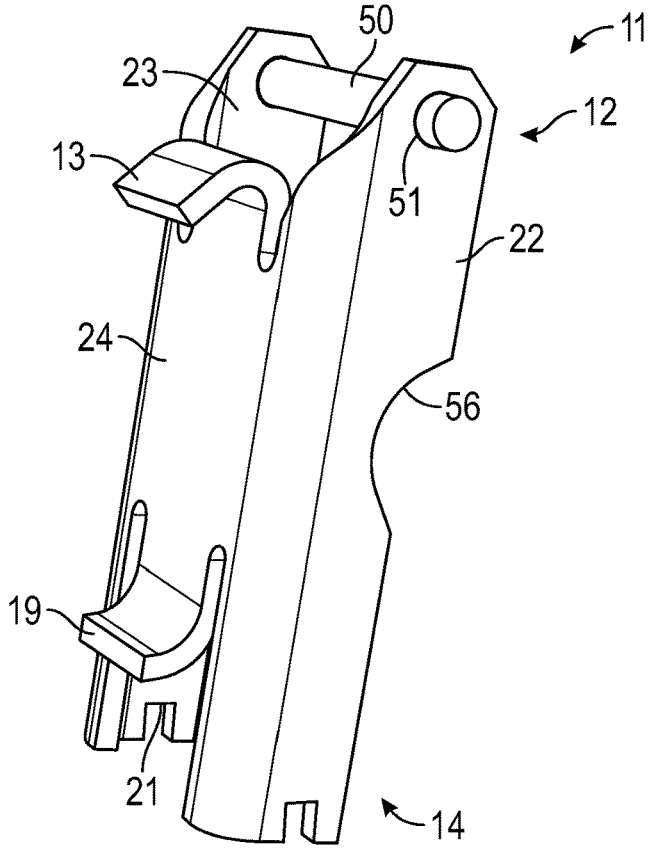

In particular in FIGS. 11A and 11B it is seen that, in the illustrated embodiment, the fastening bracket 11 is formed from a plate material bent so that it forms a U-formed profile having a central wall 24 and the two side walls 22, 23 and extending in a longitudinal direction between a first upper end 12 and a second lower end 14. When the U-formed profile is seen in cross-section, the central wall 24 may form a bottom of the U-formed cross-section and the two side walls 22, 23 may form the sides of the U-formed cross-section. Furthermore, it is seen that the hook-formed element 13 is formed as a flap bent around from an upper end of the central wall 24 of the U-formed profile and the support element 19 is formed as a flap bent around from a lower end of the central wall 24 of the U-formed profile. As it is seen, the flap forming the hook-formed element 13 and the flap forming the support element 19 are bent from the central wall 24 in at least substantially the opposite direction in relation to the direction in which the two side walls 22, 23 are bent from the central wall 24. Of course, the hook-formed element 13 and the support element 19 may have different configurations than those illustrated. For instance, the support element 19 may simply be an area or part of the central wall 24 adapted to abut the frame 4. Furthermore, in FIGS. 7 and 8 it is seen that a first end 52 of the spring 25 is attached to a pin 50 extending between the two side walls 22, 23 of the U-formed profile at the first upper end 12 of the U-formed profile, and a second end 53 of the spring 25 is attached to an edge 20 of the elongated profile 26 attached along the edge 8 of the fabric 5. Furthermore, in FIGS. 4 to 11 it is seen that the groove 21 is formed in a lower end of each of the two side walls 22, 23 of the U-formed profile at the second lower end 14 of the U-formed profile, and that the edge 20 of the elongated profile 26 fits into said grooves 21. The spring 25 is adapted to hold the edge 20 of the elongated profile 26 in said grooves 21 as seen for instance in FIG. 6. Thereby, the spring 25 is attached to the edge 20 of the elongated profile 26 between the two side walls 22, 23 of the U-formed profile. A cut-out 56 in each wall 23, 24 of the fastening bracket 11 may facilitate gripping the fastening bracket 11 by means of two fingers, in particular, when the fastening bracket has to be lifted from the first lower position 15 to the second upper position 16.

As illustrated in FIGS. 4 and 5, the edge 8 of the fabric 5 is attached to the fastening bracket 11 by means of an elongated profile 26 gripping over a thickened area 27 along the edge 8 of the fabric 5. The elongated profile 26 has a tubular cross-section 28 with a longitudinally extending slit 29 through which the fabric 5 extends, and the elongated profile 26 is attached to the fastening bracket 11 by means of at least one spring 25. The thickened area 27 along the edge 8 of the fabric 5 is formed by means of a hem 30 with a string 31 or rod inside. The elongated profile 26 is particularly well illustrated in FIG. 7, and the elongated profile 26 and the thickened area 27 are illustrated in cross-section in FIG. 9. Furthermore, the connection procedure between the elongated profile 26 and the thickened area 27 is illustrated in FIG. 14.

Figure 14:
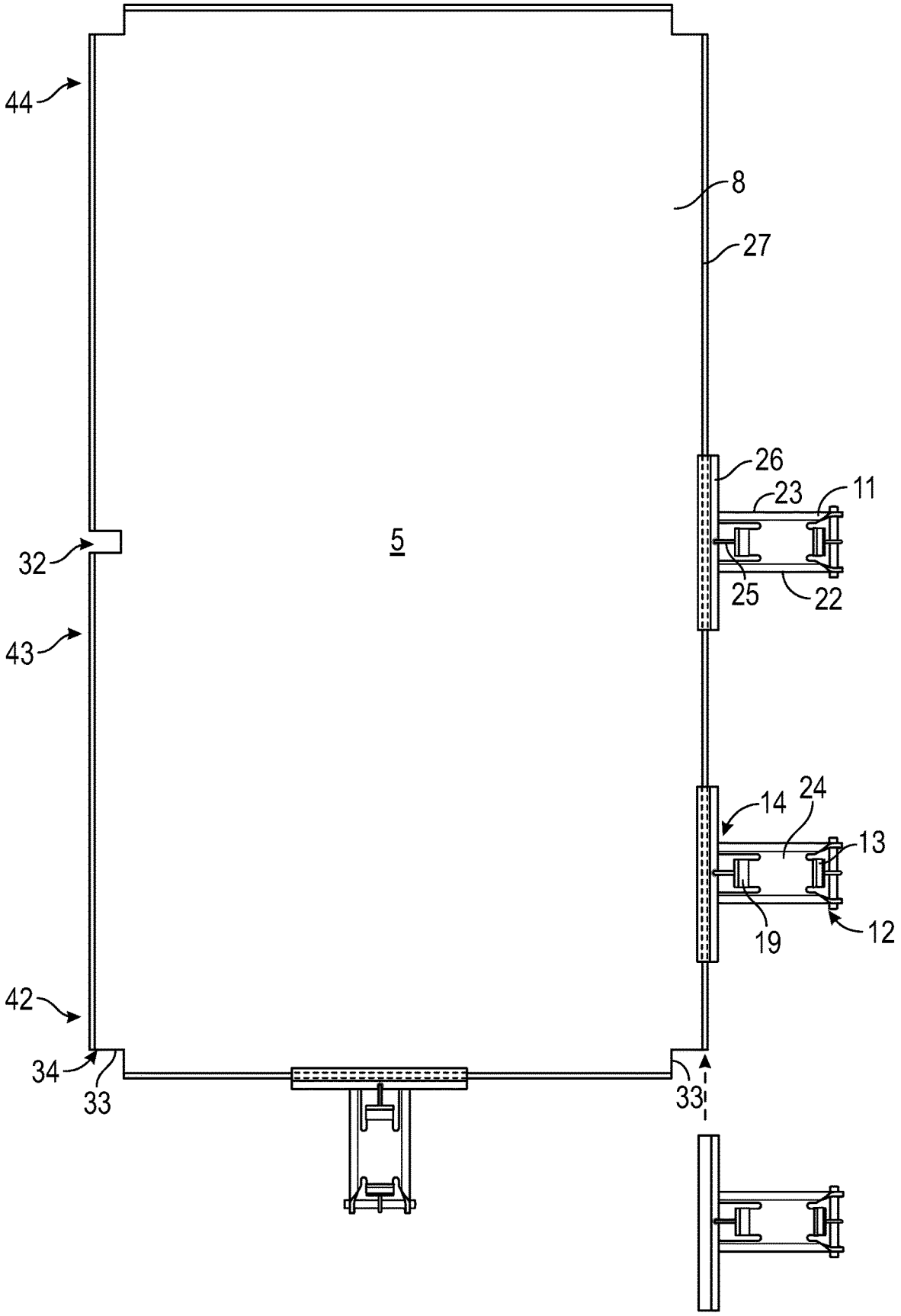
FIG. 14 is a top view of a prefabricated fabric for the panel as illustrated in FIG. 2.

As is further seen in FIG. 14, the thickened area 27 along the edge 8 of the fabric 5 is disrupted by means of mutually spaced indentations 32 in the edge 8 of the fabric 5. Thereby, some of the elongated profiles 26 may be brought to slide in over the thickened 27 area along the edges 8 of the fabric 5 through the indentations 32 in the edge of the fabric. This may facilitate the mounting of the elongated profiles 26 on the edges 8 of the fabric 5, because sliding of the elongated profiles too long a distance along the edges of the fabric may be avoided. Furthermore, the thickened area 27 along the edge 8 of the fabric 5 is disrupted by means of corner indentations 33 in the edge 8 of the fabric 5 at corners 34 of the fabric 5. Thereby, at least some of the elongated profiles 26 may be brought to slide in over the thickened area 27 along the edges 8 of the fabric 5 through said corner indentations 33. At the same time, the corner indentations 33 may serve to avoid too much fabric at the corners 34 which could otherwise lead to undesired folds or creases impairing the desired aesthetic look.

In the illustrated embodiment, the edge 8 of the fabric is adapted to be attached to the peripheral side 9 of the frame 4 by means of at least two fastening brackets 11 distributed along each elongated frame section 35. Thereby, the mounting of the fabric on relatively large frames may be facilitated, as will be understood from the description of the mounting procedure below.

Furthermore, it is seen that when the fastening bracket 11 is in its first lower position 15, the edge 8 of the fabric 5 attached to the fastening bracket 11 is positioned below the lower peripheral edge 7 of the frame 4. Thereby, without demounting the fabric 5, access may be provided to the area above the fabric and inside the frame 4. This may be advantageous, for instance in the case that the panel body 39 provided inside the frame 4 is or includes a light panel. In this case, the light panel may be serviced without demounting the fabric. Furthermore, dust on the upper side of the fabric 5 may be particularly visible from below when light is on, and it may therefore be advantageous that easy access is provided to the inside of the panel 1 so that dust may be removed without first demounting the fabric 5.

Referring to FIG. 2, the method of mounting the fabric 5 on the frame 4 of the panel 1 will be described in the following. The fabric 5 is mounted on the at least substantially rigid frame 4 after the frame has been arranged in its mounted position at a ceiling by placing a roll 40 of fabric 5 on a trolley 41 and wheeling the trolley along the at least substantially rigid frame 4 as the fabric 5 is gradually rolled out from the roll 40 of fabric 5. The roll 40 is a roll of fabric 5 having preformed thickened areas 27 along the edges 8 of the fabric 5.

The fabric 5 is mounted on the at least substantially rigid frame 4 by firstly attaching a first end 42 of the fabric 5 which is the free end of fabric of a partly unrolled roll 40 to a number of fastening brackets 11 and bringing said fastening brackets to releasably engage the peripheral side 9 of the frame 4, secondly attaching an intermediate part 43 of the fabric 5 to a number of fastening brackets 11 and bringing said fastening brackets to releasably engage the peripheral side 9 of the frame 4, and thirdly attaching a second end 44 of the fabric 5 to a number of fastening brackets 11 and bringing said fastening brackets to releasably engage the peripheral side 9 of the frame 4.

All the fastening brackets 11 necessary for mounting the fabric 5 are brought to releasably engage the peripheral side 9 of the frame 4 in their first lower position before any of the fastening brackets 11 is repositioned from its first lower position 15 to its second upper position 16. Thereby, it may be ensured that the entire fabric 5 is correctly placed and free for dust, before the fabric is finally tensioned and stretched over the frame 4. Thereby, repetitive correctional procedures may be avoided and time may be saved during mounting of the fabric 5. Subsequently, the fastening brackets may, one at a time, be repositioned from their first lower position to their second upper position, thereby stretching the fabric suitably.

FIG. 14 illustrates a top view of the prefabricated fabric rolled out. As it is seen, each fastening bracket 11 and its corresponding elongated profile 26 has been mounted to the edge of the fabric as a combined unit. Thereby, the subsequent mounting of the fabric by mounting the fastening bracket 11 on the frame 4 in its first lower position may be facilitated. The fastening bracket 11 and its corresponding elongated profile 26 are held together as a combined unit by means of the at least one spring 25 which holds the edge 20 of the elongated profile 26 in the groove 21 of the fastening bracket 11, as illustrated for instance in FIG. 6. At this state, the at least one spring 25 is at least slightly extended in order to provide a connection force between the fastening bracket 11 and its corresponding elongated profile 26. Preferably, before attaching the fabric 5 to the elongated profile 26, the at least one spring 25 is brought to hold the edge 20 of the elongated profile 26 in the groove 21 of the fastening bracket 11. In fact, each fastening bracket 11 and its corresponding elongated profile 26 may be delivered from the factory as a combined unit. Thereby, the mounting procedure may be facilitated.

During the mounting procedure, when the fastening bracket 11 is repositioned from its first lower position 15 to its second upper position 16, the at least one spring 25 is extended as illustrated for instance in FIGS. 4 and 8. Thereby, a suitable permanent stretching force may be applied to the fabric. Consequently, it may be ensured that the fabric is maintained suitably stretched.

During the mounting procedure, the intermediate part 43 of the fabric 5 is attached to at least some fastening brackets 11 by sliding the elongated profiles 26 in over the thickened area 27 along the edge 8 of the fabric 5 through an indentation 32 in the edge 8 of the fabric 5. Thereby, sliding of the elongated profiles 26 too long a distance along the edges 8 of the fabric 5 may be avoided.

In the illustrated embodiments, the fastening brackets 11 are formed from a metal plate by bending. However, alternatively, the fastening brackets 11 could be injection moulded. In this case, suitably, the fastening brackets 11 could have a form adapted to the different production procedure. Likewise, in the illustrated embodiments, the elongated profiles 26 have the form of relatively short profiles. However, alternatively, each elongated profile 26 could have the form of an longer profile, possibly extending over a third of, or half of, or the entire length of an elongated frame section 35 from a first corner section 36 to a second corner section 36.

Purely as an example, the permanent ceiling 45 illustrated in FIG. 3 could measure 30×60 metres, and the panels 1 could be almost 30 metres long. The elongated profiles 26 could then be 40 centimetres long each. The elongated profiles 26 could be placed almost abutting each other with their ends along the elongated frame sections 35, or they could be spaced. Preferably, they are spaced by a few centimetres. However, depending on the nature of the fabric and on the stiffness of the thickened area 27, they could be spaced longer apart from each other, such as 50 centimetres or even 1 metre or more. The indentations 32 could for instance be positioned with a mutual spacing of approximately 3 metres. The string 31 in the hem 30 could for instance have a diameter of 3-4 millimetres and be a cable or wire made of polyester or glass fibre.

LIST OF REFERENCE NUMBERS

1 panel
2 upper side of panel
3 lower side of panel
4 frame
5 fabric
6 lower side of frame
7 lower peripheral edge of frame
8 edge of fabric
9 peripheral side of frame
10 attachment position
11 fastening bracket
12 first upper end of fastening bracket
13 hook-formed element of fastening bracket
14 second lower end of fastening bracket
15 first lower position of fastening bracket
16 second upper position of fastening bracket
17 first lower protrusion on peripheral side of the frame
18 second upper protrusion on peripheral side of the frame
19 support element of fastening bracket
20 edge of elongated profile
21 groove of fastening bracket
22 first side wall of U-formed profile of fastening bracket
23 second side wall of U-formed profile of fastening bracket
24 central wall of U-formed profile of fastening bracket
25 spring
26 elongated profile
27 thickened area
28 tubular cross-section of elongated profile
29 longitudinally extending slit of tubular cross-section of elongated profile
30 hem
31 string
32 indentation
33 corner indentation
34 corner of fabric
35 elongated frame sections
36 corner section
37 groove of corner section
38 resilient member
39 panel body
40 roll of fabric
41 trolley
42 first end of fabric
43 intermediate part of fabric
44 second end of fabric
45 permanent ceiling of room
46 panel body section
47 reinforcement rib of frame section
48 connection part of frame section
49 oblique lower part of frame section
50 pin
51 hole
52 first end of spring
53 second end of spring
54 flat part of elongated profile
55 connection hole for spring
56 cut-out in fastening bracket
60 prior art panel
61 wire
62 working table

The invention claimed is:

1. A panel for a suspended ceiling, the panel having an upper side and a lower side and including frame and a fabric adapted to be stretched over a lower side of the frame and forming the lower side of the panel, the frame having a lower peripheral edge over which the fabric may be stretched, and an edge of the fabric being adapted to be attached releasably to a peripheral side of the frame by means of a hook-formed element gripping over a protrusion provided at the peripheral side of the frame above the lower peripheral edge of the frame, characterised in that the edge of the fabric is adapted to be attached to the peripheral side of the frame by means of a number of fastening brackets distributed along the edge of the fabric, in that the fastening brackets are adapted to be selectively attached to the peripheral side of the frame, firstly at a first lower position in which the fabric is hanging loosely under the frame, and secondly at a second upper position in which the fabric is stretched over the lower side of the frame, in that, in the first lower position of the fastening brackets, a hook-formed element of the fastening brackets grips over a first lower protrusion provided at the peripheral side of the frame and, in the second upper position of the fastening brackets, the hook-formed element of the fastening brackets grips over a second upper protrusion provided at the peripheral side of the frame, and in that the positioning of the fastening brackets, carrying the fabric, in their first lower position and the subsequent repositioning of these to their second upper position on the frame may be done when the frame is already mounted under a permanent ceiling in a building.

2. The panel according to claim 1, wherein each fastening bracket has a first upper end at which the hook-formed element is arranged and a second lower end at which a support element is arranged, and wherein the support element is adapted to abut the frame both in the first lower position of the fastening bracket and in the second upper position of the fastening bracket.

3. The panel according to claim 2, wherein the support element is adapted to, in the first lower position of the fastening bracket, grip under an edge of the frame.

4. The panel according to claim 3, wherein the edge of the fabric is attached to each fastening bracket by means of at least one spring.

5. The panel according to claim 2, wherein the edge of the fabric is attached to the first upper end of each fastening bracket by means of at least one spring.

6. The panel according to claim 5, wherein the edge of the fabric is attached to the at least one spring by means of an elongated profile attached along the edge of the fabric.

7. The panel according to claim 6, wherein the at least one spring is adapted to, in the first lower position of the fastening bracket, hold an edge of the elongated profile in a groove of the fastening bracket.

8. The panel according to claim 5, wherein the fastening bracket is adapted to, at least in the first lower position of the fastening bracket, guide the at least one spring in a longitudinal direction of the fastening bracket, said longitudinal direction extending from the first upper end to the second lower end of the fastening bracket.

9. The method of mounting a fabric on frame of a suspended ceiling by stretching the fabric over a lower side of the frame, the fabric thereby forming a lower side of a panel, by stretching the fabric over a lower peripheral edge of the frame, and by attaching an edge of the fabric releasably to a peripheral side of the frame by means of a hook-formed element gripping over a protrusion provided at the peripheral side of the frame above the lower peripheral edge of the frame, characterised by attaching the edge of the fabric to the peripheral side of the frame by means of a number of fastening brackets distributed along the edge of the fabric, whereby, in a first step, each fastening bracket is attached to the peripheral side of the frame at a first lower position in which the fabric is hanging loosely under the frame by hanging a hook-formed element of the fastening brackets on a first lower protrusion provided at the peripheral side of the frame, and, in a second step, each fastening bracket is repositioned from said first lower position to a second upper position in which the fabric is stretched over the lower side of the frame by hanging the hook-formed element of the fastening brackets on a second upper protrusion provided at the peripheral side of the frame.

10. The method of mounting according to claim 9, whereby each fastening bracket has a first upper end at which the hook-formed element is arranged and a second lower end at which a support element is arranged, and wherein the support element abuts the frame both in the first lower position of the fastening bracket and in the second upper position of the fastening bracket.

11. The method of mounting according to claim 9, whereby, in the first step, when the fastening bracket is positioned in its first lower position, the support element is positioned to grip under an edge of the frame.

12. The method of mounting according to claim 9, whereby the edge of the fabric is attached to each fastening bracket by means of at least one spring.

13. The method of mounting according to claim 9, whereby the edge of the fabric is attached to the first upper end of each fastening bracket by means of at least one spring.

14. The method of mounting according to claim 13, whereby the edge of the fabric is attached to the at least one spring by attaching an elongated profile along the edge of the fabric.

15. The method of mounting according to claim 14, whereby the at least one spring, during the first step, in which the fastening bracket is arranged in its first lower position, holds an edge of the elongated profile in a groove of the fastening bracket.

16. The method of mounting according to claim 14, whereby, before attaching the fabric to the elongated profile, the at least one spring is brought to hold an edge of the elongated profile in a groove of the fastening bracket.

17. The method of mounting according to claim 16, whereby the groove is formed in a second lower end of the fastening bracket.

18. The method of mounting according to claim 14, whereby the elongated profile is attached to the fastening bracket by means of at least one spring which is extended when the fastening bracket is repositioned from its first lower position to its second upper position.

19. The method of mounting according to claim 13, whereby the fastening bracket, at least during the first step in which the fastening bracket is arranged in its first lower position, guides the at least one spring in a longitudinal direction of the fastening bracket, said longitudinal direction extending from the first upper end to the second lower end of the fastening bracket.

20. The method of mounting according to claim 13, whereby the fastening bracket, at least during the first step in which the fastening bracket is arranged in its first lower position, takes up the at least one spring between two side walls of the fastening bracket.

* * * * *